US005738284A

United States Patent [19]

Gruendl et al.

[11] Patent Number: 5,738,284

[45] Date of Patent: Apr. 14, 1998

[54] INVERTED COIL

[75] Inventors: Robert S. Gruendl, Grafton; Stephen C. Cranford, Newport News, both of Va.

[73] Assignee: Siemens Automotive Corporation, Auburn Hills, Mich.

[21] Appl. No.: 839,535

[22] Filed: Apr. 14, 1997

Related U.S. Application Data

[63] Continuation of Ser. No. 469,394, Jun. 6, 1995, abandoned.

[51] Int. Cl.[6] ..... F02M 51/00

[52] U.S. Cl. ..... 239/585.4; 239/900

[58] Field of Search ..... 239/585.1–585.5, 239/900; 251/129.21

[56] References Cited

U.S. PATENT DOCUMENTS 4,725,041 2/1988 Chauvin ..... 239/585.4 X 5,263,649 11/1993 Babitzka et al. ..... 239/585.4

FOREIGN PATENT DOCUMENTS 19938 2/1985 Japan ..... 239/585.5

*Primary Examiner*—Kevin Weldon

*Attorney, Agent, or Firm*—Russel C. Wells

[57] ABSTRACT

A solenoid-operated fuel injector has a housing forming an enclosure which contains a solenoid coil assembly having electrical terminals extending therefrom via which the fuel injector is connected with a connector for selectively energizing the solenoid coil by electric current to operate the fuel injector. A fuel rail delivers pressurized liquid fuel to a fuel inlet which is at one axial end of the injector. Fuel is injected from the enclosure at an axially opposite nozzle outlet end. A valve mechanism is disposed within the enclosure and is operated by the solenoid coil acting through a spring-biased armature to open and close a flow path through the enclosure. The coil orientation allows the injector electrical terminal to be lowered, so the terminals exit from the bottom of the coil.

1 Claim, 1 Drawing Sheet

INVERTED COIL

This is a continuation of application Ser. No. 08/469,394 filed on Jun. 6, 1995 now abandoned.

FIELD OF THE INVENTION

This invention relates generally to electrically operated valves, such as fuel injectors for injecting liquid fuel into an internal combustion engine, and particularly to an inverted coil assembly orientation in a fuel injector.

BACKGROUND OF THE INVENTION

The movement of certain electrically-operated valves, such as certain fuel injectors, comprises a needle that is reciprocated axially within the interior of the valve's body in response to electrical energization and de-energization of an electro-mechanical actuator to thereby selectively open and close a flow path through the valve. Fuel injectors typically contain a solenoid assembly that includes an electromagnetic coil which, when energized, is operative to effect axial movement of an armature. Normally the armature, which is operatively associated with a valve movable relative to a valve seat for controlling fuel injection, is slidably received and guided by its outer peripheral surface in a guide bore in the housing of the injector. Armatures can be moved in one direction by an electro-magnetic force generated by a coil of wire and moved in the opposite direction by a return spring. When the armature impacts a stop, it bounces. Each bounce of the armature, or valving element, meters a small uncontrolled amount of fuel into the engine, to the detriment of emissions. As can be appreciated, the leakage of fuel into the engine will result in very unfavorable fuel economy. It is a common technique to mount the fuel injectors in an engine manifold or fuel rail which is constructed to include assist air passages for delivering the assist air to the individual injectors.

Injector outlines have been standard sizes for most of the manufacturing history of fuel injectors. Recent trends in downsizing of engine compartments, combined with lowering of automobile hood profiles, has driven the fuel system industry to create alternative fuel system configurations, mostly in an effort to reduce package height.

One area of length reduction has consisted of minimizing fuel injector components, and reducing O-ring to O-ring length. Traditional manufacturing and system interconnect schemes has limited the maximum reduction of injector length obtainable to that reached when the traditional fuel rail injector cup makes contact with the injector overmolded electrical connector.

Prior attempts have been made to allow the injector connector to exit the injector at a 90° angle, resulting in some downsizing. However, due to the traditional manner of having the terminals exit the top of a bobbin, the length reduction gained overall is still minimal, or is gained at the expense of a larger outer diameter to allow for the terminals to bend down outside the housing. This traditional method also relies on the housing to have passages for electrical terminal exit. This can result in costly secondary operations in addition to larger diameters required for the housing.

It is seen then that it would be desirable to have a coil assembly orientation in fuel injectors which would allow for reduced O-ring to O-ring package length.

SUMMARY OF THE INVENTION

This need is met by the coil assembly according to the present invention, wherein the coil orientation is inverted. In accordance with the present invention, the coil orientation allows the injector electrical terminal to be lowered, and the terminal exit from the housing is accomplished in a straightforward manner with minimal cost.

Briefly, the invention comprises the implementation of certain constructional features into the fuel injector in the coil region. Principles of the invention are of course potentially applicable to forms of fuel injectors other than the one specifically herein illustrated and described.

According to the present invention, a solenoid-operated fuel injector comprises a housing forming an enclosure which contains a solenoid coil that is selectively energized by electric current to operate the fuel injector. An inlet connector tube extends into the solenoid coil to convey liquid fuel into the enclosure. Fuel is injected from the enclosure via an axially opposite nozzle outlet end. A valve mechanism is disposed within the enclosure between the inlet connector tube and the outlet end, and is operated by the solenoid coil acting through a spring-biased armature to open and close a flow path through the enclosure between the inlet connector tube and the outlet. The coil orientation allows the injector electrical terminal to be lowered, so the terminals exit from the bottom of the coil.

For a full understanding of the nature and objects of the present invention, reference may be had to the following detailed description taken in conjunction with the accompanying drawings and the appended claims.

DESCRIPTION OF THE PREFERRED EMBODIMENT

Figure 1:
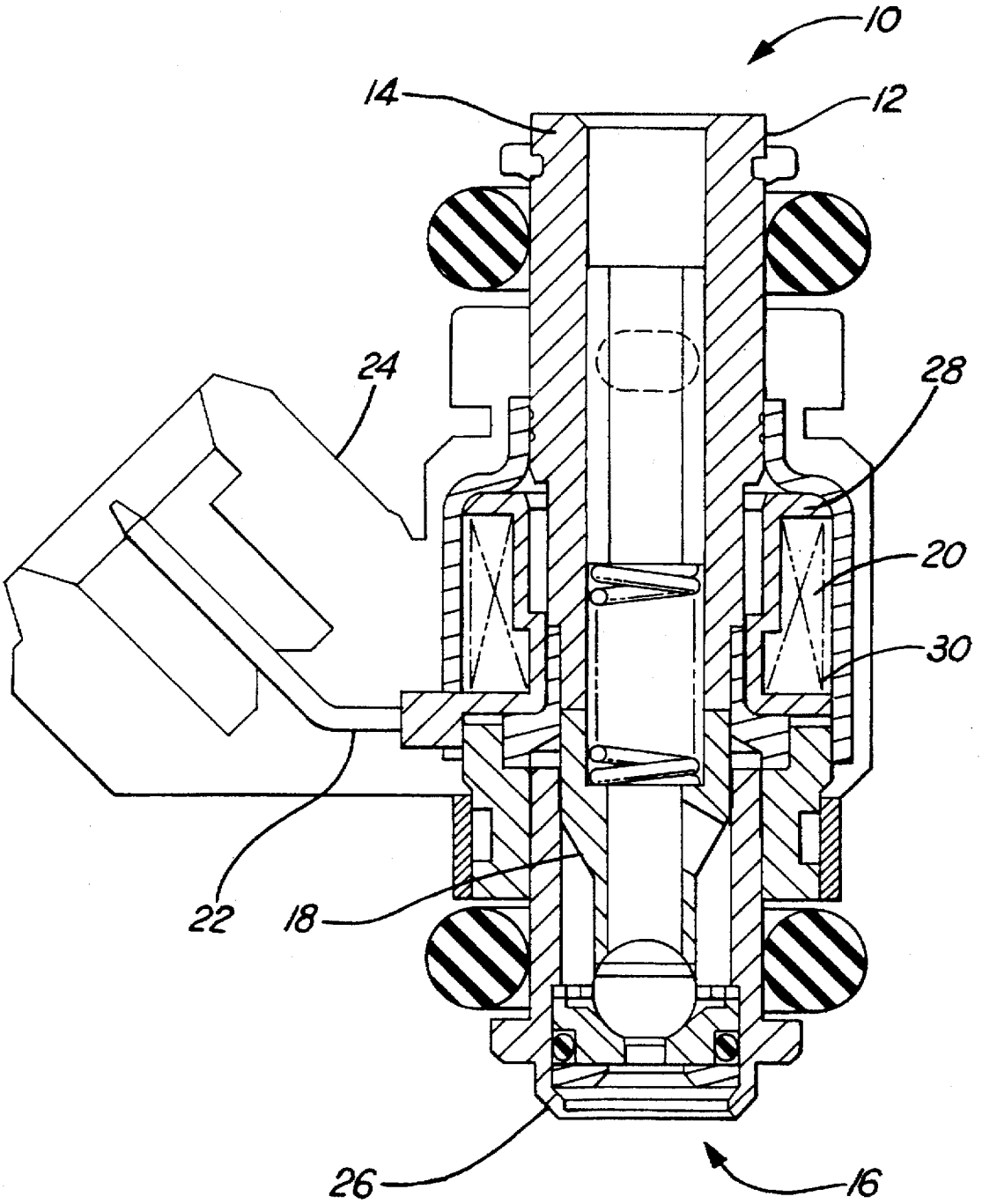
FIG. 1 is an elevational view, partly in cross section, through a fuel injector embodying the present invention.

Referring to FIG. 1 there is illustrated partly in cross section, a typical fuel injector 10 designed to inject fuel into an internal combustion engine. The fuel injector 10 includes as its major components thereof a housing 12 of magnetically permeable material; an inlet connector 14 in the form of a tube also of magnetically permeable material; an outlet end 16; an armature 18; a solenoid coil assembly 20, including electrical terminals 22 extending therefrom via which the fuel injector is connected with a connector 24, such as an electrical operating circuit, for selectively energizing the solenoid coil; and a valve body assembly 26.

The relative organization and arrangement of these various parts are essentially the same as in the fuel injector of commonly assigned U.S. Pat. No. 4,610,080. The injector is of the type which is commonly referred to as a top-feed type, wherein fuel is introduced through inlet connector 14 and emitted as injections from the axially opposite nozzle, or tip, end 16.

The differences essentially relate to the inventive features of the present disclosure. The present invention provides for reduced O-ring to O-ring package length. In addition to the smaller size, the assembly is very economical to manufacture and has performance benefits for the injector, including reduced mass.

Continuing with FIG. 1, in accordance with the present invention, the coil assembly 20 comprises a bobbin 28, electrical terminals 22 associated with connector 24, and coil winding wire 30. The coil winding wire 30 may be plain, overmolded, or taped. The coil assembly 20 is assembled over the fuel injector inlet connector 24 with the terminals 22 located in the position furthest from the fuel rail. The fuel rail (not shown) is associated with the fuel injector 10 to deliver pressurized liquid fuel to the injector's fuel inlet which is at one axial end of the injector. The terminals 22 can be arranged in a variety of ways, including in the traditional manner, parallel to the bobbin 28 outer diameter; or, more preferably, the terminals 22 can be oriented perpendicular to the bobbin 28 outer diameter. The terminals 22 can be present to a desired position, or can be bent after the assembly is housed in housing 12.

The unique location and orientation of the terminals allows for the housing 12 to be assembled from the top of the injector 10. With the present invention, the housing 12 can now have a slot in its bottom diameter to allow for the terminal 22 passage, resulting in a smaller outer diameter and a lower cost housing.

The package size reduction obtained is equal to the height removed by relocating the connector 24, and is now limited by the fuel rail injector clip location versus the housing height. The present invention therefore provides for a compact and economical method for reducing the injector package size. The unique coil assembly orientation results in lower cost, easier manufacture of components, and simpler assembly of the injector. The coil orientation allows the injector terminal and, therefore, the fuel injector inlet connector, to be lowered, as compared to the injector length.

Having described the invention in detail and by reference to the preferred embodiments thereof, it will be apparent that principles of the invention are susceptible to being implemented in other forms of solenoid-operated valves without departing from the scope of the invention defined in the appended claims.

What is claimed is:

1. In an electromechanically operated top feed fuel injector having a tubular housing with at least two axially spaced apart upper and lower O-rings respectively located at each end of the housing, the upper O-ring for sealingly locating the inlet of the fuel injector in a fuel rail and the lower O-ring for sealingly locating the outlet end of the fuel injector in an engine manifold, a connector axially located between the O-rings and having terminals for receiving electrical signals for operating the injector, an overmold encapsulating the housing and connector and axially extending between the upper and lower O-rings, wherein the improvement comprises:

a solenoid inside the housing and having a tubular bobbin member with a coil wound on said bobbin and each end of said coil connected respectively to the terminals of the connector at one end of said bobbin nearest the lower O-ring for locating the connector closer to the lower O-ring and between the O-rings thereby reducing the axial spacing between the O-rings for reducing the length of the injector.

* * * * *